United States Patent [19]

Coiner et al.

[11] 4,126,415

[45] Nov. 21, 1978

[54] ANTISTATIC CARPET

[75] Inventors: Marsha H. Coiner, Chesterfield; John C. Haylock, Midlothian; Julian H. Newland, Richmond; Judd L. Schwartz, Chester, all of Va.

[73] Assignee: Allied Chemical Corporation, Morris Township, Morris County, N.J.

[21] Appl. No.: 841,256

[22] Filed: Oct. 12, 1977

[51] Int. Cl.[2] ..... D06M 3/16; D06M 3/26; D06M 5/10; C08G 73/04

[52] U.S. Cl. ..... 8/115.5; 8/100 A; 8/115.6; 8/DIG. 18; 260/857 G; 260/873; 204/159.19; 428/96; 428/97

[58] Field of Search ..... 8/DIG. 18, 115.5, 100; 260/2 EN, 857 G; 204/159.19; 427/390 B

[56] References Cited

U.S. PATENT DOCUMENTS

| | | | |
|---|---|---|---|
| 3,350,340 | 10/1967 | Soenksen et al. | 260/2 EN |
| 3,442,975 | 5/1969 | Cawthon et al. | 260/2 EN |
| 3,479,215 | 11/1969 | Cavagna et al. | 428/342 |
| 3,988,503 | 10/1976 | Ariyoshi et al. | 8/115.5 |

FOREIGN PATENT DOCUMENTS

| | | | |
|---|---|---|---|
| 6,414,650 | 7/1964 | Japan | 8/100 |

OTHER PUBLICATIONS

Chemical Abstracts, vol. 56, 4988b (1962), vol. 57, 4904i (1962), vol. 81, 148345a (1975).

*Primary Examiner*—Joseph L. Schofer
*Assistant Examiner*—Maria S. Tungol
*Attorney, Agent, or Firm*—Fred L. Kelly

[57] ABSTRACT

An antistatic pile carpet having a relatively pliable primary backing and a tufted surface, said surface being comprised of fibers selected from the group consisting of polyester and polyamide fibers having grafted thereon from 1 to 5 percent by weight of a conductive polymeric salt of a polyethylenimine having a molecular weight of 200 to 10,000 and a sulfonic acid compound of the formula

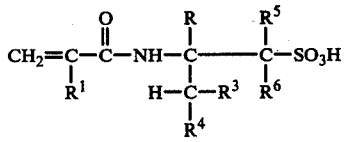

wherein $R^1$, $R^2$, $R^3$, $R^4$, $R^5$ and $R^6$ are individually hydrogen or a lower alkyl radical having 1–3 carbon atoms.

20 Claims, No Drawings

ANTISTATIC CARPET

BACKGROUND OF THE INVENTION

The present invention relates to a carpet having improved antistatic properties and to a process for the preparation thereof. More particularly, the invention relates to graft polymerization of a polymeric salt to a polyester or polyamide carpet to improve its antistatic properties.

When carpeting is conventionally manufactured, the fibers or pile are tufted on a relatively pliable primary backing which may be manufactured from any suitable materials such as jute or a man-made fiber such as polypropylene. The nonwear side of the backing is then coated with a bonding material of any suitable type such as latex. The latex serves to satisfactorily hold the fibers in place so that they cannot be pulled free from the primary backing and also to bond the primary backing to the secondary backing. In the past, clay has been added to the latex as a filler to reduce the cost of the bonding compound. The secondary backing, which may also be jute or artificial fiber, strengthens the carpet and ensures that the bonding material does not come into contact with the floor upon which the carpet is laid.

A number of proposals has been made for grafting a selected material to the surface of synthetic fibers, fabrics, carpets and other substrates to improve properties such as dyeability, antistatic properties, resistance to soiling, abrasion resistance and wettability. The most pertinent prior art is believed to be U.S. Pat. No. 3,600,122 which discloses grafting an ethylenically unsaturated monomer to a polymeric substrate that has been activated for said grafting by subjecting the substrate to a spark discharge in a zone of free radical initiating gas. Other patents relating to graft polymerization include U.S. Pat. Nos. 3,088,791; 3,092,512; 3,188,228; 3,313,591; 3,412,176; 3,670,048; 3,977,954, and British Patent Specification No. 923,851.

Although these patents constitute a major contribution to this art, investigations have been continued to develop an improved antistatic carpet wherein the antistatic properties are particularly durable to usual carpet cleaning procedures.

SUMMARY OF THE INVENTION

It is an object of this invention to provide a process for rendering pile carpets antistatic without impairing their aesthetic properties. Another object of this invention is to provide pile carpets having improved antistatic properties over conventional polyester and polyamide carpets. It is a further object of this invention to provide an improved antistatic carpet wherein the antistatic properties are durable to usual carpet cleaning procedures.

In summary, the present invention provides an antistatic pile carpet having a relatively pliable primary backing and a tufted surface, said surface being comprised of fibers selected from the group consisting of polyester and polyamide fibers having grafted thereon from 1 to 5 percent by weight of a conductive polymeric salt of a polyethylenimine having a molecular weight of 200 to 10,000 and a sulfonic acid compound of the formula

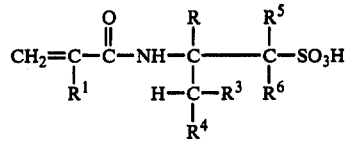

wherein $R^1$, $R^2$, $R^3$, $R^4$, $R^5$, and $R^6$ are individually hydrogen or a lower alkyl radical having 1–3 carbon atoms.

The process of the present invention is an improvement over known processes for producing a pile carpet having a relatively pliable primary backing through which polyamide or polyester fibers are tufted. The improvement comprises:

(a) subjecting said carpet to a spark discharge for 1 to 100 minutes in a zone of free radical initiating gas to generate free radical sites on the fibers of said carpet;

(b) subsequently exposing said carpet to oxygen or air;

(c) then exposing said carpet to an aqueous solution of a conductive polymeric salt formed by reacting a polyethylenimine having a molecular weight of 200 to 10,000 with an equivalent amount of a sulfonic acid compound of the formula

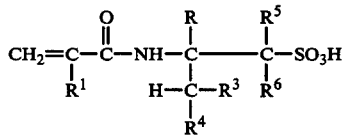

wherein $R^1$, $R^2$, $R^3$, $R^4$, $R^5$ and $R^6$ are individually hydrogen or a lower alkyl radical having 1–3 carbon atoms; and (d) then heating said carpet to a temperature of 50° C. to 150° C. to form a graft copolymer of said conductive polymeric salt and said carpet fibers.

The aqueous solution of the conductive polymeric salt used in the process of the present invention preferably contains about 5 to 25 percent by weight of said salt. Preferably, the carpet is exposed to a sufficient amount of said solution to provide 1 to 5 percent by weight of said conductive polymeric salt on the carpet fibers.

The initiation of free radical sites may be accomplished by subjecting the carpet for 1 to 100 minutes to a so-called "spark discharge" in a zone containing an initiator gas. The spark discharge is maintained between suitably spaced electrodes by appropriately adjusting the pressure of the initiator gas and the voltage between the electrodes, and the initiator gas is selected to activate the surface of the carpet fibers by forming free radical sites on the surface without the initiator gas itself reacting with the free radical sites thereby formed on the surface. The initiator gas is preferably selected from the group consisting of argon, hydrogen and helium.

The acrylamidoalkanesulfonic acids useful in the process of the present invention are known compounds and some are commercially available. They may be prepared in accordance with U.S. Pat. No. 3,506,707, assigned to The Lubrizol Corporation. The polyethylenimines are also known compounds, which are commercially available from The Dow Chemical Company.

The term "antistatic carpet" is used herein to mean that the build-up of static charge on a person walking across the carpet is very low even under conditions of low atmospheric humidity, e.g., 20 percent relative humidity at 21° C. The preferred method of testing for antistatic properties is the procedure described in the *Technical Manual of the American Association of Textile Chemists and Colorists,* 1975 edition, Volume 51, at pages 207–209. This test procedure is entitled "Electrostatic Propensity of Carpets" and is numbered AATCC Test Method 134-1975. In accordance with this test, carpets of the present invention showed excellent antistatic properties before and after cleaning as demonstrated in the specific examples hereinafter.

The present invention provides an antistatic carpet which retains its aesthetic properties and is much more antistatic after cleaning than prior art carpets. We postulate that this improvement in permanency of antistatic properties results from a multiplicity of linkage groups between the polyester or polyamide in the carpet fiber and the conductive polymeric salt, i.e., the synergistic combination of the polyethylenimine and the sulfonic acid compound in equivalent proportions provides a conductive polymeric salt, which in accordance with the process of this invention can form a ladder polymer comprising said conductive polymeric salt linked by a multiplicity of linkage groups to the polyester or polyamide in the carpet fiber.

DESCRIPTION OF THE PREFERRED EMBODIMENT

The preferred polyamides which are useful in the improved carpets of the present invention include polycaprolactam, the polyamides which are derived from the condensation of a dicarboxylic acid with a diamine, such as polyhexamethylene adipamide and polyhexamethylene sebacamide, and copolymers thereof. The preferred polyesters are the linear terephthalate polyesters, i.e., polyesters of a glycol containing from 2 to 20 carbon atoms and a dicarboxylic acid component containing at least about 75 percent terephthalic acid. The remainder, if any, of the dicarboxylic acid component may be any suitable dicarboxylic acid such as sebacic acid, adipic acid, isophthalic acid, sulfonyl-4,4'dibenzoic acid, or 2,8-dibenzofuran-dicarboxylic acid. The glycols may contain more than two carbon atoms in the chain, e.g., diethylene glycol, butylene glycol, decamethylene glycol, and bis-1,4-(hydroxymethyl)cyclohexane. Examples of linear terephthalate polyesters which may be employed include poly(ethylene terephthalate) and poly(butylene terephthalate).

The primary carpet backing is made from any suitable material. It may be a conventional woven jute construction. Also, the backing may be made of a non-woven fibrous mass made of cellulosic or noncellulosic material including nylon, polyester, and polyolefin. Other fabric backing structures likewise can be used.

We prefer to graft onto the polyester or polyamide fibers from 1 to 3 percent by weight of a conductive polymeric salt of a polyethylenimine having a molecular weight of 200 to 2,000, and a sulfonic acid compound of the formula

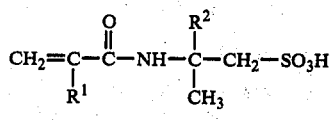

wherein $R^1$ and $R^2$ are individually hydrogen or a lower alkyl radical having 1–3 carbon atoms.

The following examples serve to illustrate the present invention. Unless otherwise indicated, all parts and percentages are by weight.

EXAMPLE 1

A first solution is formed by mixing together 1,400 parts of water, 100 parts of polyethylenimine having an average molecular weight of about 600, and 17.5 parts of a commercial nonionic surfactant (Triton X-100).

A second solution is formed by mixing together 125 parts of water and 18.8 parts of p-methoxyphenol, then slowly adding 125 parts of 2-acrylamide-2-methylpropane sulfonic acid.

The first solution is then titrated with the second solution until the equivalence point is reached at pH 4.5. The resulting composition is a milky white liquid. For convenience, this composition may be called Composition A.

EXAMPLE 2

In accordance with this invention, Composition A of Example 1 is used to produce an antistatic carpet having excellent durability to carpet cleaning procedures. A typical polyamide carpet may be produced as follows: A reactor equipped with a heater and stirrer is charged with a mixture of 1,520 parts of epsilon-caprolactam and 80 parts of aminocaproic acid. The mixture is then flushed with nitrogen and stirred and heated to 255° C. over a 1-hour period at atmospheric pressure to produce a polymerization reaction. The heating and stirring is continued at atmospheric pressure under a nitrogen sweep for an additional four hours in order to complete the polymerization. Nitrogen is then admitted to the reactor and a small pressure is maintained while the polymer is extruded from the reactor in the form of a polymer ribbon. The polymer ribbon is subsequently cooled, pelletized, washed and then dried. The polymer is a white solid having a relative viscosity of about 50 to 60 as determined at a concentration of 11 grams of polymer in 100 ml. of 90 percent formic acid at 25° C. (ASTM D-789-62T).

The polymer is melt extruded under pressure of 1,500 psig. to a 70-orifice spinnerette to produce a fiber having about 3,600 denier. The fiber is collected, drawn at about 3.2 times the extruded length and textured with a steam jet to produce yarn suitable for use in carpet. The yarn is two-plied by twisting two ends together with a 1.5 S twist. The yarn is tufted into a level loop 22-ounce/yard$^2$ carpet at about 8 stitch rate. A relatively pliable nonwoven polypropylene fabric is used as the primary backing. Tufting is carried out on a conventional tufting machine operated to give a pile having a height of 5/32 to 7/32 inch. An untreated portion of this carpet is used as a control and a second portion is treated in accordance with the present invention.

In accordance with the invention, the carpet is first subjected to a spark discharge in a zone of free radical initiating gas (argon gas) to generate free radical sites on the fibers of the carpet. To accomplish this, the carpet to be treated is placed in a chamber on a cluster of parallel rods and draped over several rods or wound around the cluster of rods to form a hollow cylinder of fibers. One electrode is centrally arranged within the rod cluster, the other surrounds the rod cluster. The chamber is closed and evacuated to a pressure of 0.1 torr, a voltage of 220–230 volts is applied across the electrode system, and argon is bled into the chamber at a pressure of 0.25 torr. A uniform spark discharge occurs and free radical sites are generated on the carpet fibers. The carpet is subjected to these conditions for 15–90 minutes. At the end of this period, the argon source and voltage supply are shut down, vacuum system isolated from the chamber and the pressure within the chamber raised to atmospheric by introduction of air. The resulting carpet is sprayed with Composition A of Example 1 to give a wet pickup of 1–2 percent solids on the carpet fibers. The treated carpet is dried at 100°–125° C. and cured at 100°–125° C. for 5 minutes. The treated and untreated carpets are then given a jute secondary backing using a conventional latex binder.

For convenience, the treated carpet is called Carpet A and the untreated carpet is called Carpet B. The following table compares the carpets with respect to antistatic properties (before and after steam cleaning) as measured by the above-described AATCC Test Method 134-1975.

| Carpet System | Static Level, Kv | |
|---|---|---|
| | Initial | After Steam Cleaning |
| Carpet A | 2.0 | 2.1 to 3.1 |
| Carpet B | 9.7 | 10.2 to 11.4 |

These results indicate that the static level of Carpet A is significantly improved over that of Carpet B and that the static level of Carpet A is surprisingly durable to steam cleaning.

Similar results are obtained when a polyethylene terephthalate carpet is used.

EXAMPLE 3

The carpet treatment procedure of Example 2 is followed except that the carpet is not subjected to a spark discharge in a zone of free radical initiating gas. For convenience, this treated carpet is called Carpet C.

The following table compares Carpet C with Carpet A of Example 2, using the above-described AATCC Test Method 134-1975.

| Carpet System | Static Level, Kv | |
|---|---|---|
| | Initial | After Steam Cleaning |
| Carpet A | 2.0 | 2.1 to 3.1 |
| Carpet C | 1.8 | 9.4 to 9.6 |

This example demonstrates that heat treatment of the conductive polymeric salt on the carpet fiber is not sufficient to make the carpet durable to steam cleaning.

We claim:

1. An antistatic pile carpet having a relatively pliable primary backing and a tufted surface, said surface being comprised of fibers selected from the group consisting of polyester and polyamide fibers having grafted thereon from 1 to 5 percent by weight of a conductive polymeric salt formed by reacting a polyethylenimine having a molecular weight of 200 to 10,000 and a sulfonic acid compound of the formula

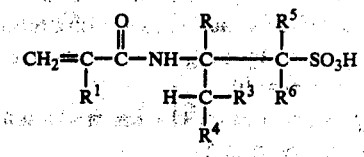

where $R^1$, $R^2$, $R^3$, $R^4$, $R^5$ and $R^6$ are individually hydrogen or a lower alkyl radical having 1 to 3 carbon atoms.

2. The carpet of claim 1 wherein the sulfonic acid compound has the formula

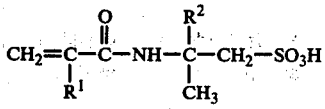

where $R^1$ and $R^2$ are individually hydrogen or a lower alkyl radical having 1 to 3 carbon atoms.

3. The carpet of claim 1 wherein the sulfonic acid compound is 2-acrylamide-2-methylpropane sulfonic acid.

4. The carpet of claim 1 wherein the polyethylenimine has a molecular weight of 200 to 2,000.

5. The carpet of claim 1 wherein the polyethylenimine has an average molecular weight of about 600.

6. The carpet of claim 1 wherein the fibers are polyamide fibers.

7. The carpet of claim 6 wherein the polyamide fibers are polycaprolactam fibers.

8. The carpet of claim 6 wherein the polyamide fibers are polyhexamethylene adipamide fibers.

9. The carpet of claim 1 wherein the fibers are polyester fibers.

10. The carpet of claim 9 wherein the polyester fibers are polyethylene terephthalate fibers.

11. In a process for producing a pile carpet having a relatively pliable primary backing through which polyamide or polyester fibers are tufted, the improvement which comprises:

(a) subjecting said carpet to a spark discharge for 1 to 100 minutes in a zone of free radical initiating gas to generate free radical sites on the fibers of said carpet;

(b) subsequently exposing said carpet to oxygen or air;

(c) then exposing said carpet to an aqueous solution of a conductive polymeric salt formed by reacting a polyethylenimine having a molecular weight of 200 to 10,000 with an equivalent amount of a sulfonic acid compound of the formula

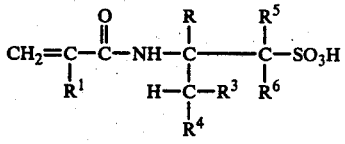

where $R^1$, $R^2$, $R^3$, $R^4$, $R^5$ and $R^6$ are individually hydrogen or a lower alkyl radical having 1 to 3 carbon atoms; and (d) then heating said carpet to a temperature of 50° C. to 150° C. to form a graft copolymer of said conductive polymeric salt and said carpet fibers.

12. The process of claim 11 wherein the aqueous solution of the conductive polymeric salt contains about 5 to 25 percent by weight of said salt, and the carpet is exposed to a sufficient amount of said solution to provide 1 to 5 percent by weight of said conductive polymeric salt on the carpet fibers.

13. The process of claim 11 wherein the sulfonic acid compound has the formula

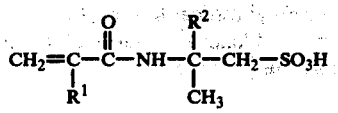

where $R^1$ and $R^2$ are individually hydrogen or a lower alkyl radical having 1 to 3 carbon atoms.

14. The process of claim 11 wherein the sulfonic acid compound is 2-acrylamide-2-methylpropane sulfonic acid.

15. The process of claim 11 wherein the polyethylenimine has a molecular weight of 200 to 2,000.

16. The process of claim 11 wherein the fibers are polyamide fibers.

17. The process of claim 16 wherein the polyamide fibers are polycaprolactam fibers.

18. The process of claim 16 wherein the polyamide fibers are polyhexamethylene adipamide fibers.

19. The process of claim 11 wherein the fibers are polyester fibers.

20. The process of claim 19 wherein the polyester fibers are polyethylene terephthalate fibers.

* * * * *